United States Patent [19]

Murakami et al.

[11] Patent Number: 4,873,905

[45] Date of Patent: Oct. 17, 1989

[54] AUTOMATIC PLAYER PIANO

[75] Inventors: Kazuo Murakami; Yasutoshi Kaneko; Takasi Tamaki, all of Shizuoka, Japan

[73] Assignee: Yamaha Corporation, Hamamatsu, Japan

[21] Appl. No.: 194,872

[22] Filed: May 17, 1988

[30] Foreign Application Priority Data

May 18, 1987 [JP] Japan ..... 62-74670[U]
Aug. 26, 1987 [JP] Japan ..... 62-129333[U]

[51] Int. Cl.[4] ..... G10F 1/02; G10C 3/20
[52] U.S. Cl. ..... 84/20; 84/246
[58] Field of Search ..... 84/18, 20, 21, 22, 25, 84/67, 224, 462, 246, 1.18, DIG. 7, 107

[56] References Cited

U.S. PATENT DOCUMENTS

| | | | |
|---|---|---|---|
| 784,508 | 3/1905 | Weber | 84/20 |
| 1,138,103 | 5/1915 | Hauss et al. | 84/20 |
| 4,338,847 | 7/1982 | Brennan | 84/20 |
| 4,351,221 | 9/1982 | Starnes et al. | 84/21 X |
| 4,362,934 | 12/1982 | McLey | 84/DIG. 7 X |
| 4,513,652 | 4/1985 | Muramatsu et al. | 84/20 |
| 4,592,262 | 6/1986 | Yang | 84/462 X |

FOREIGN PATENT DOCUMENTS

| | | | |
|---|---|---|---|
| 27624 | 3/1977 | Japan | 84/DIG. 7 |
| 31722 | 3/1977 | Japan | 84/DIG. 7 |
| 990164 | 4/1965 | United Kingdom | 84/20 |

*Primary Examiner*—W. B. Perkey
*Attorney, Agent, or Firm*—Burns, Doane, Swecker & Mathis

[57] ABSTRACT

An automatic player piano comprises (a) a keyboard provided with a plurality of keys each having a front end portion, an intermediate portion and a rear end portion, the front end portion being pressed by a player for requesting a sound, (b) a key supporting unit provided on a key bed and having a front rail capable of engagement with the front end portion, a back rail capable of engagement with the rear end portion and a balance rail provided between the front rail and the back rail and rockably supporting the intermediate portion, (c) a sound producing mechanism associated with each of the keys and operative to produce the sound, (d) a plurality of key action mechanisms each engagable with the rear end portion of each key and operative to transfer a motion of the key to the sound producing mechanism, and (e) a plurality of key actuator units each provided between the front and balance rails of the key supporting unit and operative to pull down each of the keys for requesting a sound upon activation thereof. The hollow space between the front rail and the balance rail is substantially equal over various piano, so that a common key actuator unit assembly may be incorporated in the automatic player piano of different models.

6 Claims, 6 Drawing Sheets

PRIOR-ART

PRIOR-ART

PRIOR-ART

AUTOMATIC PLAYER PIANO

FIELD OF THE INVENTION

This invention relates to an automatic player piano and, more particularly, to a key actuator unit incorporated in the automatic player piano.

BACKGROUND OF THE INVENTION

In general, an automatic player piano has a plurality of keys coupled to respective key action mechanisms, and each of the keys is driven by a solenoid-operated key actuator unit for producing a sound. A typical example of the automatic player piano is disclosed in Japanese Utility Model Application laid-open Kokai) No. 113584/1980 and the general arrangement thereof is illustrated in FIG. 1 of the drawings. In FIG. 1, reference numeral 1 designates a keyboard unit consisting of a plurality of white and black keys 2 and 3 each accompanied by a key action mechanism 4, and each of the keys is rockably supported by a balance rail 5 provided on a key bed 6, so that the key action mechanism 4 is driven for causing a hammer ( not shown ) to hit a string 7 when the key is pressed by a player. The automatic player piano illustrated in FIG. 1 further comprises a plurality of solenoid-operated key actuator units 8 and 9 each provided in association with each of the keys which is connected at a rear end portion thereof to the solenoid-operated key actuator unit. Each of the solenoid-operated key actuator units 8 and 9 is energized by a controller 10, so that the key mechanism 4 is driven for causing the hammer to hit the string 7 upon activation of the solenoid-operated key actuator unit.

Turning to FIG. 2 of the drawings, solenoid-operated key actuator units 11 and 12 are illustrated in association with a key board 13 consisting of a plurality of keys including a key 14, and this arrangement is disclosed in Publication of Japanese Utility Model Application ( Kokoku ) No. 15838/1987. The solenoid-operated key actuator units 11 and 12 are supported by a retainer 15, and the retainer 15 is attached at upper and lower end portions thereof to a bracket member 16 which in turn is fixed to the lower surface of a key bed 17. Each of the solenoid-operated key actuator units 11 and 12 largely comprises, as shown in FIG. 3, a cylindrical guide member 21 formed of brass, a coil bobbin 22 snugly received on the outer surface of the cylindrical guide member 21, a coil wire 23 wound on the outer surface of the coil bobbin 22, a movable member 24 slidably received in the cylindrical guide member 21, a covering member 25 attached to the coil bobbin 22 for covering the coil wire 23 and a plunger 26 connected to the movable member 24 to drive the key. The solenoid-operated key actuator 11 or 12 thus arranged deeply retracts the movable member 24 in non-activating state as will be seen from FIG. 3, however the movable member 25 is moved in the cylindrical guide member 21 to allow the plunger 26 to upwardly push the rear end portion of the key when the coil wire 23 is supplied with a current. In this arrangement, magnetic saturations take place around the top and bottom end portions of the cylindrical guide member 21, so that the movable member 24 is designed to move into a magnetic equilibrium position when the actuator is energized.

However, a problem is encountered in the prior-art automatic player piano illustrated in FIG. 2 in that various solenoid-operated key actuators different in size are needed for a line of products different in size and model from one another. This is because of the fact that the automatic player piano of one model has a key action mechanism different in size and/or arrangement from that of another model. The key action mechanisms are thus different from one another depending upon the piano model, so that the solenoid-operated key actuators should be designed to correspond to the differences among the key action mechanisms of the different piano models.

Moreover, if the solenoid-operated key actuator illustrated in FIG. 3 is used in the automatic player piano, another problem is encountered in occupation space of the solenoid-operated key actuator. Namely, the solenoid-operated key actuator illustrated in FIG. 3 has a relatively long length in the moving direction of the movable member 24, because the key actuator needs to provide a relatively long driving stroke as it drives a key at a point relatively distant from the balance rail 5.

SUMMARY OF THE INVENTION

It is therefore an important object of the present invention to provide an automatic player piano which is equipped with key actuators applicable to another automatic player piano different in size or model.

It is another important object of the present invention to provide an automatic player piano which is equipped with key actuators occupying a relatively small space.

To accomplish these objects, the present invention proposes to provide key actuator units in a space between the front rail and the balance rail which is substantially equal in volume over the automatic player pianos of different models.

In accordance with the present invention, there is provided an automatic player piano comprising: (a) a keyboard provided with a plurality of keys each having a front end portion, an intermediate portion and a rear end portion, the front end portion being pressed by a player for requesting a sound; (b) key supporting means each provided on a key bed and having a front rail capable of engagement with the front end portion, a back rail capable of engagement with the rear end portion and a balance rail provided between the front rail and the back rail and rockably supporting the intermediate portion; (c) a sound producing mechanism associated with the keys and operative to produce a sound; (d) a plurality of key action mechanisms each engagable with the rear end portion of each key and operative to transfer a motion of the key to the sound producing mechanism; and (e) a plurality of key actuator units each provided between the front and balance rails of the key supporting means and operative to pull down each of the keys for requesting a sound upon activation thereof.

Each of the key actuator units may comprise an elongated plate member rockably supported by a bracket, a hook member fixed to each key and capable of being brought into engagement with one end of the elongated plate member and a solenoid-operated key actuator operative to push the other end of the elongated plate member for pulling down the hook member. The automatic player piano may further comprise a bracket member supporting the key actuator units and movable with respect to the key bed. For engagement between the elongated plate member and the movable member, the elongated plate member has a bifurcated end portion and the hook member has a vertical plate and a horizontal plate connected to the vertical plate in crossing manner.

In another implementation, each of the key actuator units may comprise a hook member fixed to a front end portion of each key, a bracket member, an elongated plate member rockably supported at a rear end portion thereof by the bracket member, a resilient member provided between the bracket member and the elongated plate member and urging the elongated plate member, and a solenoid-operated actuator having a cylindrical coil bobbin fixed on the bracket member, a coil wire wound on the outer surface of the cylindrical bobbin and a movable member rockably supported by an intermediate portion of the elongated plate member and movably received in the coil bobbin, wherein the elongated plate member has a bifurcated front end portion capable of being brought into abutting engagement with the hook member.

BRIEF DESCRIPTION OF THE DRAWINGS

The features and advantages of an automatic player piano according to the present invention will be more clearly understood from the following description taken in conjunction with the accompanying drawings in which.

DESCRIPTION OF THE PREFERRED EMBODIMENTS

First Embodiment

Figure 1:
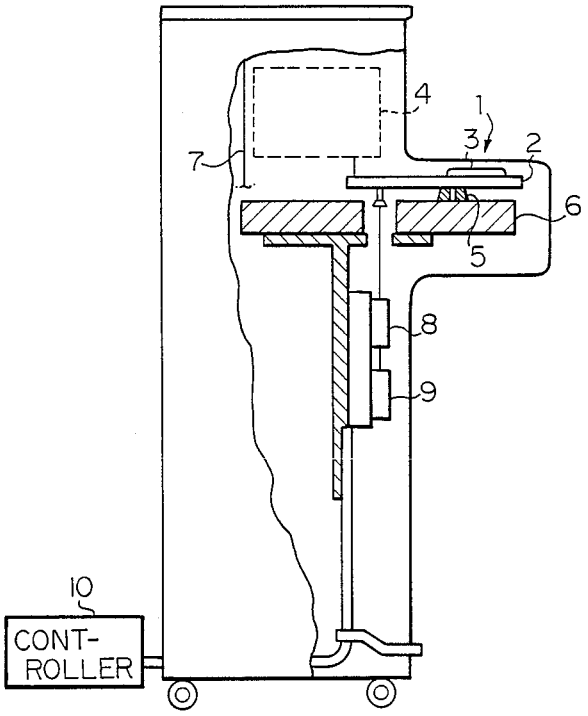
FIG. 1 is a fragmentary sectional view showing the arrangement of the automatic player piano disclosed in Japanese Utility Model Application laid-open No. 113584/1980.
Figure 2:
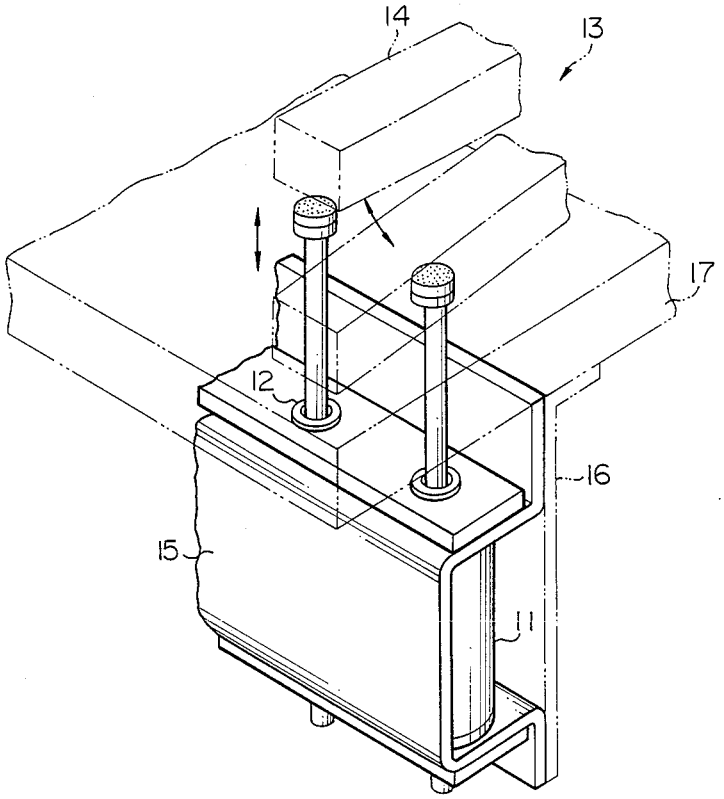
FIG. 2 is a perspective view showing the arrangement of the solenoid-operated key actuators in association with the keyboard disclosed in Publication of Japanese Utility Model Application No. 15838/1987.
Figure 3:
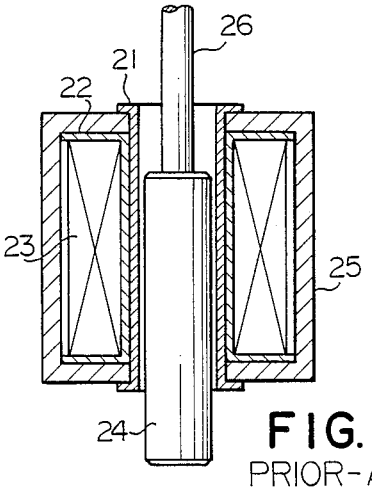
FIG. 3 is a cross sectional view showing the arrangement of the solenoid-operated key actuator incorporated in the automatic player piano illustrated in FIG. 2.
Figure 4:
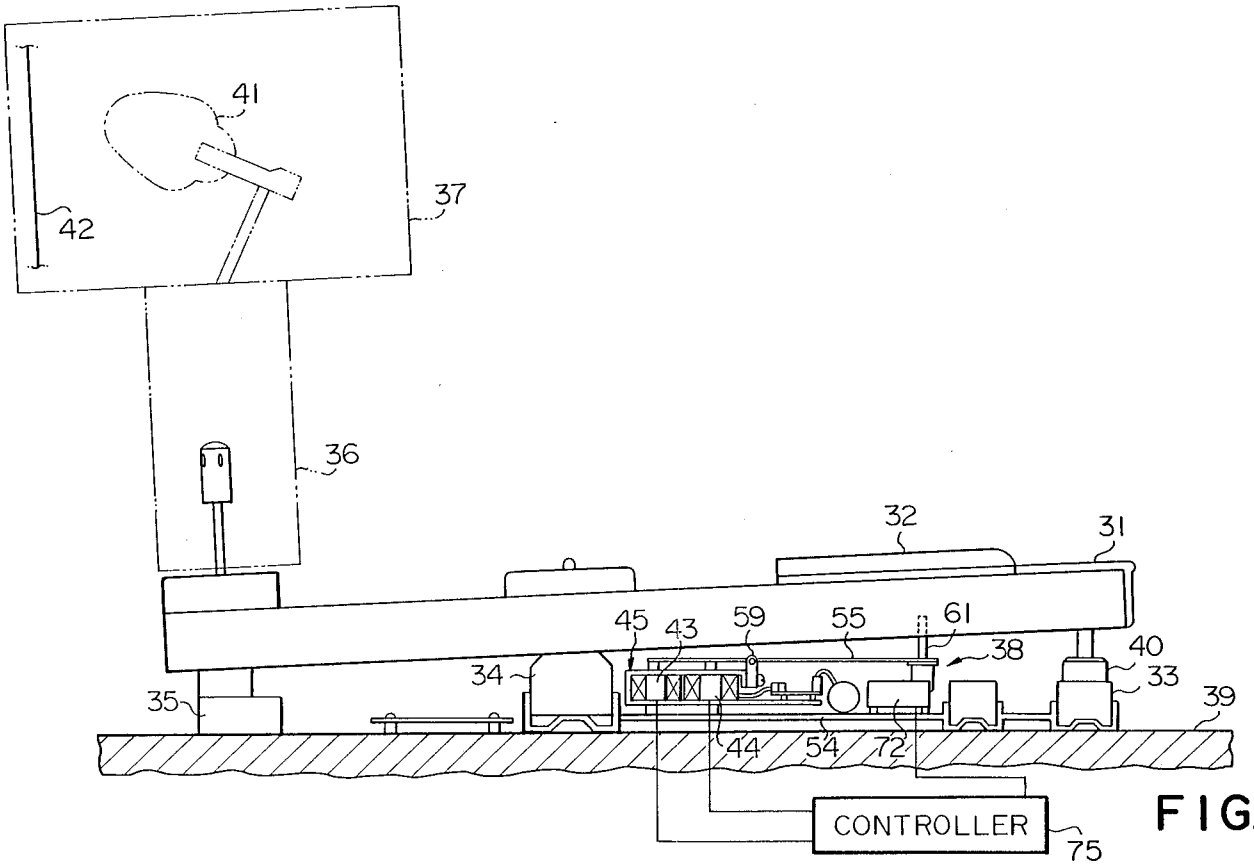
FIG. 4 is a side view showing the arrangement of an automatic player piano embodying the present invention.

Referring to FIG. 4 of the drawings, there is shown an essential part of an automatic player piano embodying the present invention. The automatic player piano illustrated in FIG. 4 largely comprises a keyboard consisting of a plurality of white keys (one of which is designated by reference numeral 31) and plural black keys (one of which is denoted by reference numeral 32), a key supporting structure associated with each of the keys and having a front rail 33, a balance rail 34 and a back rail 35, a plurality of key action mechanisms one of which is designated by reference numeral 36, a plurality of sound producing mechanisms including a sound producing mechanism 37, and a plurality of key actuator units one of which is associated with the white key 31 and denoted by reference numeral 38.

The key supporting structure is provided on a key bed 39, and the front, balance and back rails of each key supporting unit are located underneath the related key in spacing relationship from one another. For example, the white key 31 is rockably supported at the intermediate portion thereof by the balance rail 34, so that the white key 31 can be rockably moved with respect to the balance rail 34 until a front pin cloth punching 40 or the rear end portion of the key 31 is brought into contact with the front rail 33 or the back rail 35.

As to the key action mechanisms, the arrangement thereof is well known in the art, so that no further description is incorporated. Each of the sound producing mechanisms comprises a hammer 41 and a string 42, and the key action mechanism 36 converts the rockable motion of the key 31 into a snap motion which causes the hammer 41 to turn toward the string 42, so that the hammer 41 hits the string 42 for producing a sound.

Figure 5:
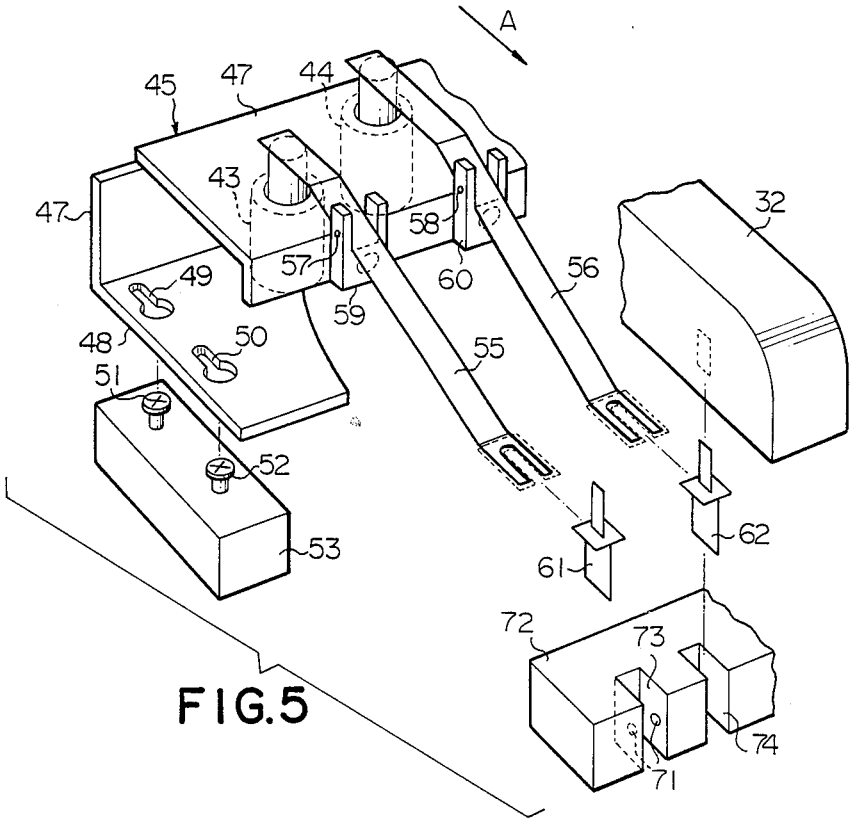
FIG. 5 is a perspective view showing the key actuator unit assembly of the automatic player piano shown in FIG. 4 in a disassembled state.

All of the key actuator units comprises solenoid-operated actuators, respectively, and are identical in structure with one another, however the solenoid-operated actuators including the actuators 43 and 44 are arranged in a staggered manner as illustrated in FIG. 5, so that a large number of helix elements of the coil wire are incorporated in each of the solenoid-operated actuators even if the occupation space is limited. Then, the solenoid-operated actuators incorporated in the key actuator units can produce large forces, respectively, which result in increasing the dynamic ranges of the sounds produced by the sound producing mechanisms, respectively.

Figure 6:
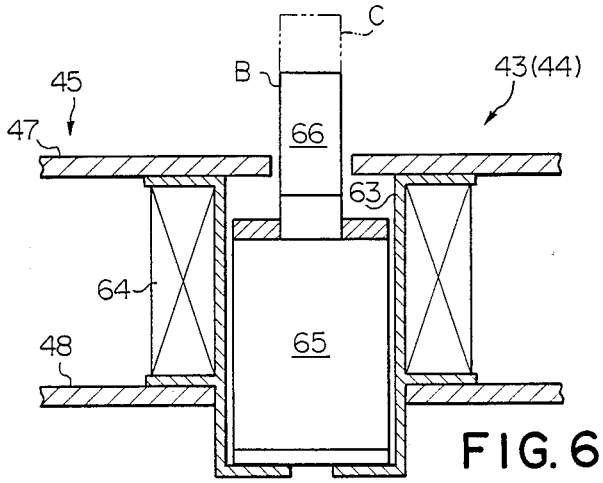
FIG. 6 is a cross sectional view showing the solenoid-operated actuator incorporated in the key actuator unit illustrated in FIG. 5.

The key actuator units are arranged between the front rail 33 and the balance rail 34 and supported by a bracket 45 which has a vertical plate 46 and upper and lower plates 47 and 48 perpendicularly projecting from the upper and lower end portions of the vertical plate 46. Two slits 49 and 50 are formed in both side portions of the lower plate 48, and each of the slits 49 and 50 has a relatively narrow portion and a relatively wide portion. The wide portion of each slit is wide enough to allow the head portion of each screw bolt 51 or 52 to pass therethrough, however the narrow portion is slightly wider than the step portion of each screw bolt 51 or 52. Upon assemblage, the bracket 45 thus arranged pass through the head portions of the screw bolts to be placed on block members one of which is designated by reference numeral 53 and, then, is slid on the block members in a direction indicated by arrow A until the stem portions of the screw bolts are placed into the narrow portions of the slits, respectively. When the bracket reaches an appropriate position described hereinafter, the screw bolts are turned to fix the bracket 45 onto the block members. The block members are secured on a key frame 54 provided on the key bed 39, so that the bracket 45 and, accordingly, the key actuator units are fixed with respect to the key bed 39. Each of the key actuator units further comprises a elongated plate member 55 or 56, and the solenoid-operated actuator 43 or 44 is contacted with the rear end portion of the elongated plate member 55 or 56. The elongated plate member 55 or 56 is rockably supported by a pin 57 or 58 which in turn is supported by a bifurcated bracket member 59 or 60. The bifurcated bracket members 59 and 60 are attached to the front end of the upper plate 47, so that the elongated plate member 55 and 56 can be rocked around the pins 57 and 58, respectively. The elongated plate members 55 and 56 have respective bifurcated front end portions, and hook members 61 and 62 are fixed to the front end portions of the keys 31 and 32, respectively. Each of the hook members 61 and 62 has a generally cross-shape, so that each of the bifurcated front end portions is brought into abutting engagement with each hook member 61 or 62. When the key actuator units are assembled with the block members, the bracket 45 is moved in the direction indicated by arrow A until the bifurcated front end portions are brought into abutting engagement with the hook members 61 and 62, respectively. Moreover, each of the hook members 61 and 62 has a certain length in the direction indicated by arrow A, so that the elongated plate members are adjustable with respect to the hook members 61 and 62 by slight sliding on the block members 53. For this reason, the arrangement of the key actuator units are advantageous in absorption of irregularities of component parts. Each of the solenoid-operated actuators 43 and 44 has a structure illustrated in FIG. 6 which comprises a cylindrical coil bobbin 63 snugly received between the upper and lower plates 47 and 48 of the bracket 45, a coil wire 64 wound on the outer surface of the cylindrical coil bobbin 63, a movable member 65 movably received in a hollow space defied in the cylindrical coil bobbin 63, and a rod member 66 projecting from the upper surface of the movable member 65 and contacting with the rear end portion of the elongated plate member 55 or 56. The movable member 65 is placed in the bottom portion of the hollow space during no current flows on the coil wire 64 as indicated by a real line B, however the movable member is driven for projection and reaches a certain position indicated by a phantom line C when energized.

The automatic player piano according to the present invention further comprises a plurality of photo-couplers one of which is designated by reference numeral 71. Each of the photo couplers is supported by a retainer 72 with a plurality of slits including the slits 73 and 74, and each slit 73 or 74 intervenes between the photo-emitting element and the photo-sensing element of each photo-coupler 71. The retainer 72 is positioned on the key frame 54 in such a manner that the lower portion of each hook member 61 or 62 passes through the slits 73 or 74 when each key is moved downwardly. Then, the motion of each key is detected by each sensor unit, and the lower portion of each hook member 61 or 62 serves as a shutter. When the sensor unit detects the motion of the key, an electric signal representing the key motion is produced and transferred to a controller 75 for storage.

In general, even if automatic player pianos are different in model from that illustrated in FIG. 4, each of the different automatic player pianos has a distance between the front rail and the balance rail and a height from the key bed to the lower surface of each key similar to those of the automatic player piano illustrated in FIG. 4. This means that the hollow space between the front rail 33 and the balance rail 34 is approximately equal in volume to those of the different models. If the key actuator units 43 and 44, the bracket 45 and the retainer 72 is arranged to be accommodated in the hollow space between the front rail 33 and the balance rail 34, the actuator units 43 and 44, the bracket 45 and the retainer 72 are available to another automatic player piano of a different model.

In operation, the automatic player piano illustrated in Fig. 4 has at least two different modes except for the usual playing as a mechanical piano. In the following description, the two modes are called as a recording mode and a playback mode. In the recording mode of operation, a player pushes the keys and operates pedals ( not shown ) in accordance with a piano score. When the player pushes the front end portion of the key 31, the key 31 is driven for rotation with respect to the balance rail 34 until the front pin cloth punching 40 is brought into abutting engagement with the front rail 33. The hook member 61 also downwardly moves and blocks an optical path of the sensor unit 71, so that the motion of the key 31 is detected by the sensor unit 71 to produce the electric signal representing the key motion which is transferred to the controller 75 for storing the information of the detected key motion therein. Thus, the key motions are detected by the associated sensor units and the informations of the key motions are stored in the controller 75 for the playback mode of operation. The key action mechanism 36 is also activated to transfer the motion of the key 31, and, for this reason, the hammer 41 hits the string to produce the sound.

In the playback mode of operation, the controller 75 produces actuating signals representative of the read-out informations, respectively. Each of the actuating signals is supplied to the key actuator unit associated with the key originally pressed by the player. Assuming now that one of the actuating signals is fed to the key actuator unit 43, the solenoid-operated actuator thereof is energized to cause the movable member 65 to push the rear end portion of the elongated plate member 55, so that the elongated plate member is driven for rotation, thereby pulling down the hook member 61. This results in activation of the key action mechanism 36. When the key action mechanism 36 is activated, the motion of the key 31 is converted into the snap motion, so that the hammer 41 is driven for rotation toward the string 42. Then, the hammer 41 hits the string 42 and the sound is reproduced as similar to the original performance.

Second Embodiment

Figure 7:
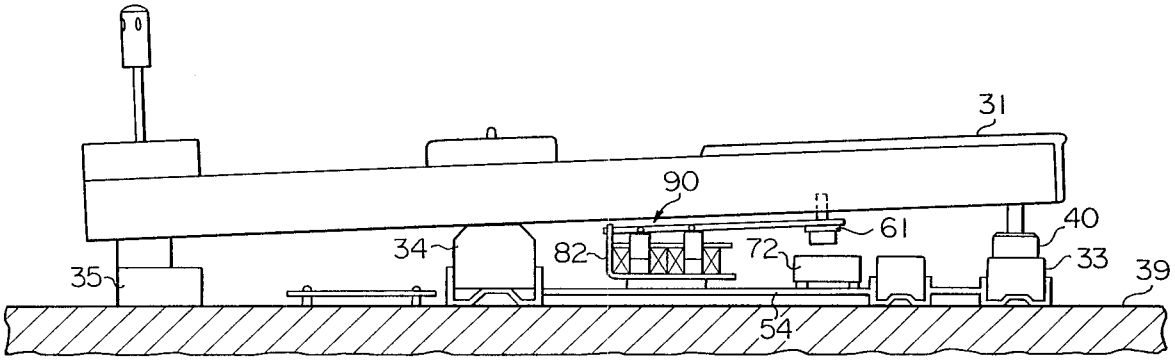
FIG. 7 is a side view showing the arrangement of another automatic player piano embodying the present invention.
Figure 8:
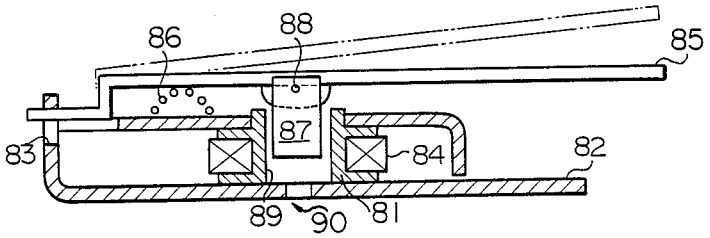
FIG. 8 is a fragmentary sectional view showing the structure of the key actuator unit incorporated in the automatic player piano illustrated in FIG. 7.

Turning to FIG. 7 of the drawings, another structure of an essential part incorporated in another automatic player piano of the present invention is illustrated. The essential part of the automatic player piano is similar in structure to that illustrated in FIG. 4 except for key actuator units, so that counter parts and members are denoted by like reference numerals used in FIG. 4. Each of the key actuator units incorporated in the automatic player piano illustrated in FIG. 7 comprises a cylindrical coil bobbin 81 supported by a generally box-shaped bracket member 82 formed with an opening 83 at the rear vertical portion thereof, a coil wire 84 wound on the outer surface of the cylindrical coil bobbin 81, an elongated plate member 85 having a rear end portion inserted into the opening 83, a spring member 86 provided between the bracket member 82 and the elongated plate member 85 and urging the elongated plate member in a direction toward the key, and a movable member 87 rockably connected to an intermediate portion of the elongated plate member 85 by means of a pin 88. The movable member 87 is loosely inserted into a through hole 89 formed in the cylindrical coil bobbin 81 to upwardly protrude in the non-energized state of the key actuator, and the coil bobbin 81, the coil wire 84 and the movable member as a whole constitute a solenoid-operated actuator 90. The elongated plate member 85 has a bifurcated front end portion which is brought into abutting engagement with the hook member 61. When the key actuator unit is energized, the movable member 87 is retracted into the coil bobbin 81 to pull down the key 31. The automatic player piano illustrated in FIG. 7 is similar in operation to that illustrated in FIG. 4, so that no further description is incorporated hereinunder. However, the automatic player piano illustrated in FIG. 7 further has an advantage over the prior-art in production of larger force because of the direct connection between the movable member 87 and the elongated plate 85. Namely, the elongated plate member 85 is positioned immediately over the bracket member 82 due to the direct connection, so that the distance between the elongated plate member 85 and the key frame 54 is fully used for providing a solenoid-operated actuator with a large height or a larger number of helix elements of the coil wire 84. This results in increasing in force which in turn results in broadening the dynamic range of the sound produced by the sound producing mechanism 37.

Figure 9:
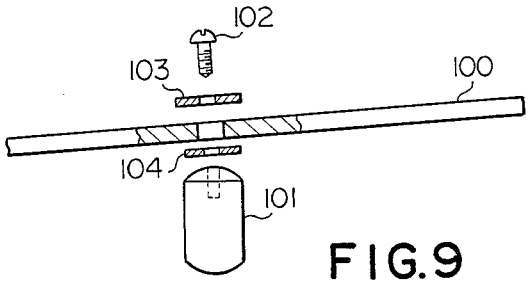
FIG. 9 is a fragmentary sectional view showing a modification of the key actuator unit shown in FIG. 8 in a disassembled state.

In FIG. 9 of the drawings is illustrated a modification of the arrangement between the movable member 87 and the elongated plate member 85 which comprises an elongated plate member 100 formed with a circular opening, a movable member 101 which is rockable supported by the elongated plate member 100. For rockable connection between the elongated plate 100 and the movable member 101, a bolt 102 is used. The bolt 102 has a stem portion smaller in diameter than the circular opening but approximately equal to openings respectively formed in spacer plates 103 and 104. The bolt 102 has a head portion larger in diameter than the openings formed in the spacer plates 103 and 104, and the bolt 102 passes through the openings respectively formed in the spacer plates 103 and 104 and the elongated plate member 100 and is screwed into the upper portion of the movable member 101 for rockable supporting.

Although particular embodiment of the present invention have been shown and described, it will be obvious to those skilled in the art that various changes and modifications may be made without departing from the spirit and scope of the present invention. Particularly, the structure for connecting the movable member of the key actuator unit with the key may be modified.

What is claimed is:

1. An automatic player piano comprising (a) a keyboard provided with a plurality of keys each having a front end portion, an intermediate portion and a rear end portion, said front end portion being pressed by a player for requesting a sound;

(b) key supporting means each provided on a key bed and having a front rail capable of engagement with said front end portion, a back rail capable of engagement with said rear end portion and a balance rail provided between the front rail and the back rail and rockably supporting said intermediate portion;

(c) a sound producing mechanism associated with said keys and operative to produce a sound;

(d) a plurality of key action mechanisms each engageable with the rear end portion of each key and operative to transfer a motion of the key to said sound producing mechanism; and (e) a plurality of key actuator units each provided between said front and balance rails of said key supporting means and operative to pull down each of said keys for requesting a sound upon activation thereof, in which each of said key actuator units comprises a solenoid-operated key actuator movable up and down and means for connecting said key actuator to a lower side of each of said keys so that the key is pulled down when the key actuator is energized, wherein each of said key actuator units comprises an elongated plate member rockably supported by a bracket, a hook member fixed to each key and capable of being brought into engagement with one end of the elongated plate member, and the solenoid-operated key actuator operative to drive the other end of the elongated plate member for pulling down the hook member.

2. An automatic player piano as set forth in claim 1, in which said elongated plate member has a bifurcated end portion and in which said hook member has a vertical plate and a horizontal plate connected to the vertical plate in a crossing manner, wherein said bifurcated end portion is brought into abutting engagement with the horizontal plate.

3. An automatic player piano comprising (a) a keyboard provided with a plurality of keys each having a front end portion, an intermediate portion and a rear end portion, said front end portion being pressed by a player for requesting a sound;

(b) key supporting means each provided on a key bed and having a front rail capable of engagement with said front end portion, a back rail capable of engagement with said rear end portion and a balance rail provided between the front rail and the back rail and rockably supporting said intermediate portion;

(c) a sound producing mechanism associated with said keys and operative to produce a sound;

(d) a plurality of key action mechanisms each engageable with the rear end portion of each key and operative to transfer a motion of the key to said sound producing mechanism; and (e) a plurality of key actuator units each provided between said front and balance rails of said key supporting means and operative to pull down each of said keys for requesting a sound upon activation thereof, in which each of said key actuator units comprises a hook member fixed to a front end portion of each key, a bracket member, an elongated plate member rockably supported at a rear end portion thereof by the bracket member, a resilient member provided between the bracket member and the elongated plate member and urging the elongated plate member, and a solenoid-operated actuator having a cylindrical coil bobbin fixed on the bracket member, a coil wire wounded on the outer surface of the cylindrical bobbin and a movable member rockably supported by an intermediate portion of the elongated plate member and movably received in the coil bobbin, wherein said elongated plate member has a bifurcated front end portion capable of being brought into abutting engagement with said hook member.

4. An automatic player piano as set forth in claim 3, in which said movable member is connected at an upper end portion thereof to said elongated plate member by means of a pin member.

5. An automatic player piano as set forth in claim 3, in which said elongated plate member is formed with a through hole and in which a bolt loosely passes through said through hole and is screwed into said movable member so as to interconnect the movable member and the elongated plate member.

6. An automatic player piano as set forth in claim 5, in which a spacer member is provided between said movable member and said elongated plate member.

* * * * *